United States Patent [19]

Bentley

[11] 4,406,331

[45] Sep. 27, 1983

[54] PIPE WIPER

[75] Inventor: Norman P. Bentley, Wheeler, Tex.

[73] Assignee: Charlies Rental, Wheeler, Tex.

[21] Appl. No.: 340,968

[22] Filed: Jan. 20, 1982

[51] Int. Cl.[3] ..... E21B 33/08

[52] U.S. Cl. ..... 175/84; 175/210; 166/82; 15/104.04

[58] Field of Search ..... 175/84, 195, 209–211; 166/82, 84; 15/104.04

[56] References Cited

U.S. PATENT DOCUMENTS

| | | | |
|---|---|---|---|
| 2,222,082 | 11/1940 | Lemon et al. | 175/195 |
| 2,846,247 | 8/1958 | Davis | 175/84 |
| 2,941,783 | 6/1960 | Stirson | 175/210 |
| 3,173,502 | 3/1965 | Overby | 175/210 |

FOREIGN PATENT DOCUMENTS

| | | | |
|---|---|---|---|
| 696144 | 11/1979 | U.S.S.R. | 175/84 |

*Primary Examiner*—William F. Pate, III

*Attorney, Agent, or Firm*—C. Clark Dougherty, Jr.

[57] ABSTRACT

The wiper apparatus of this invention is arranged to be located and to seat on top of the rotary head structures such as a Williams Connector or Shaffer blow-out preventor located on top of the casing. This apparatus wipes the mud from the surface of the pipe and, also, provides a catch basin to trap objects such as wrenches and the like which might fall through the casing were it not for this wiper structure. Additionally, this wiper structure provides for damping the vibration of the drill pipe string and assists the slips on the rotary table or rig derrick floor to grasp the drill pipe string and hold it in position while segments of such drill pipe string are added to or removed from the string.

2 Claims, 9 Drawing Figures

FIG. 4
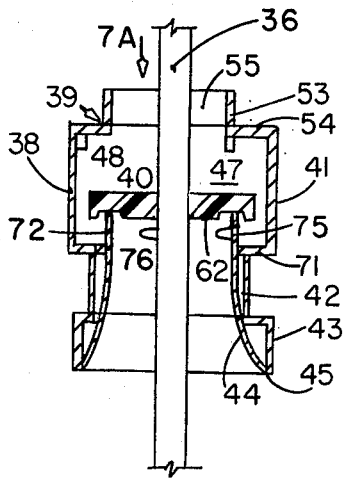
FIG. 6
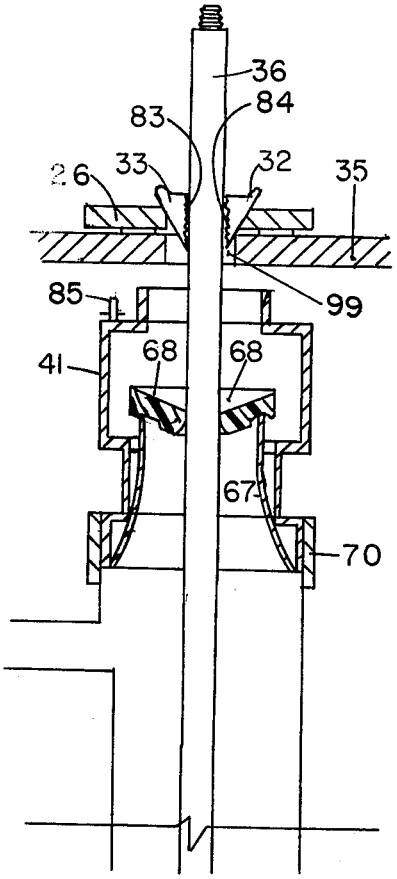
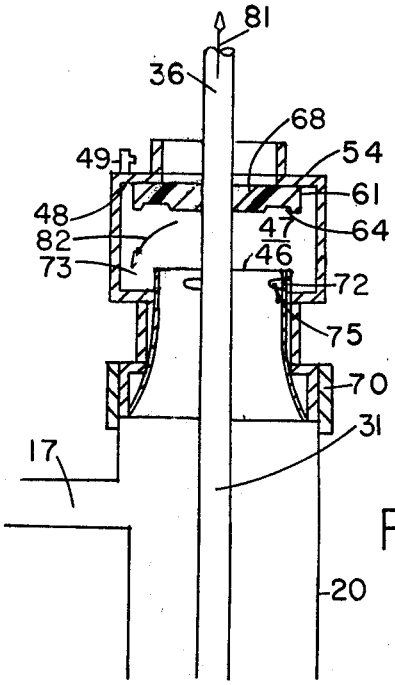
FIG. 5

PIPE WIPER

This invention relates to drilling rig equipment.

DESCRIPTION OF THE PRIOR ART

When the conventional drill pipe string is raised the drilling mud which is adherent to the outside of the drill pipe string rises with the drill pipe with which it is in contact and (a) makes difficult the handling of the drill pipe as well as (b) spilling over the floor and making footing of the operators on the floor slippery and hazardous as well as (c) being wastefull of the drilling mud liquid which currently costs about $100.00 per barrel and so is expensive.

SUMMARY OF THE INVENTION

The wiper apparatus (37) of this invention is arranged to be located and to seat on top of the rotary head structures such as a Williams Connector or Shaffer blow-out preventor (70) located on top of the casing. This apparatus (37) wipes the mud from the surface of the pipe and, also, provides a catch basin to trap objects such as wrenches and the like which might fall through the casing were it not for this wiper structure. Additionally, this wiper structure provides for damping the vibration of the drill pipe string (31) and assists the slips as (32 and 33) on the rotary table or rig derrick floor to grasp the drill pipe string and hold it in position while segments of such drill pipe string are added to or removed from the string.

BRIEF DESCRIPTION OF THE DRAWINGS

FIG. 4 is a vertical longitudinal sectional view along section 4A—4A of FIG. 7 of the apparatus 37 during the stage of operation thereof wherein the ring 40 is in its lowered position.

FIG. 5 is a longitudinal vertical section of the apparatus 37 in the position of parts thereof wherein the ring 40 is in its elevated position.

FIG. 6 is a vertical longitudinal sectional view of the apparatus 37 and neighboring parts of the system in which it works during the stage of operation of the apparatus 37 wherein it serves to damp horizontal vibration of the top of the drill string 31.

DESCRIPTION OF THE PREFERRED EMBODIMENT

Figure 1:
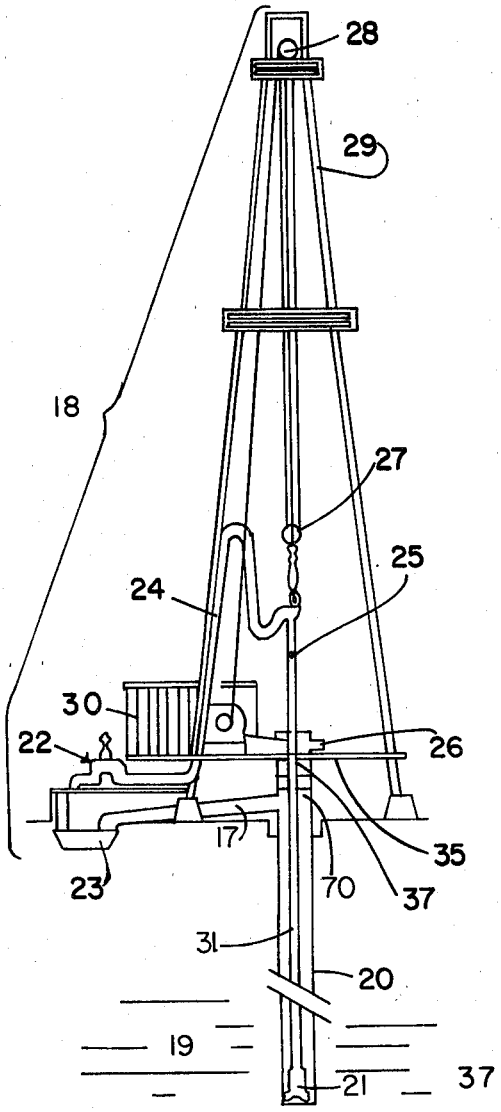
FIG. 1 is an overall view of the system in which the apparatus of this invention operates.
Figure 2:
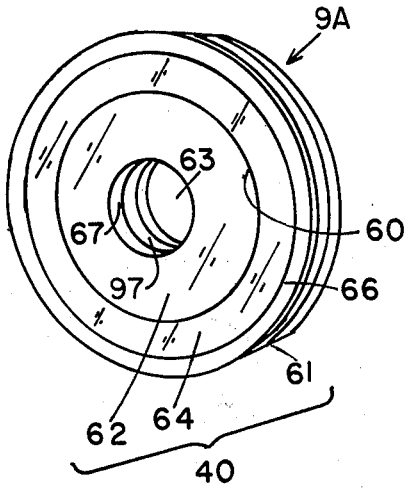
FIG. 2 is an oblique bottom view of the ring 40 used in the apparatus 37.

Generally in a rotary drilling rig 18 a casing 20 extends through the below-ground strata 19 in which a bit 21 is operated. A mud pump 22 pumps drilling mud from a pit 23 through a mud hose 24 to the top of the drill pipe string to a square sectioned pipe 25 known as the kelly. The mud passes downward through the string of drill pipe 31 to the bit and thence up the casing carrying cuttings from the bit via line 17 to the mud pit. A traveling block 27 serves to raise and lower the drill pipe string 31 for replacement of the bit as needed while the string is supported on a crown block 28 at the top of the derrick 29. An engine 30 serves to operate the rotary table 26 and the draw works which raise and lower the pipe string.

The pipe wiper apparatus 37 of this invention comprises a rigid cylindrical body 38, a removable rigid cap 39, and a resilient annular ring 40.

The body 38 comprises a rigid upper cylindrical bowl 41, a rigid shell 42 of lesser diameter than the bowl 41, and a rigid rim 43 of usually larger diameter than the shell. A rigid internal guide 44 is firmly attached to the bottom edge 45 of the rim 43 and projects to a narrower circular upper edge 46. The guide 44 is flared outwardly or radially from the narrower upper smoothed edge 46 to its bottom edge 45. The upper edge 46 projects into a bowl chamber 47. Rim 43 is of a size adapted to fit into and be located in and supported on rotary head structure as 70.

The body 38 is axially symmetrical about its center through which longitudinal center each segment, as 36, of the drill pipe string 31 passes. Releasable connecting means are provided between the cap and the bowl. The inner wall of the bowl 41 is provided with a plurality of like lugs such as 48 and 48A and 48B on the top of each of which pins as 49, 50, and 51 fixed to such lugs extend through holes in the plate 54 of cap 39. The cap 39 is formed of an inner upper rigid cylindrical sleeve 63 and a lower flat circular rigid plate 54 firmly joined together and surounding an opening 55 located directly below the central hole 99 in floor 35. The plate 54 has holes as 56 therein, one for each of the lugs 49, 50, and 51. The plate 54 also supports a rigid lug 57 which engages a notch 58 in the wall 41 to align the pins as 49, 50, and 51 for location in the respective holes therefor.

The ring 40 has an outer circular edge 61, an imperforate flat smooth bottom face 62, and a central cylindrical hole 63. A smooth flat annular groove 64 is provided in the ring bottom face 62 and that groove has an inner central groove shoulder 65 and a outer or radial groove shoulder 66. The ring inner hole face 67 is cylindrical. The top face 68 of the ring 41 is imperforate, flat and the entire mass of the ring 40 is a resilient oil resistant rubber such as a urethane type of synthetic plastic. Such synthetic plastics are described in "Rubber Technology" by M. Morton (published by Van Nostrand-Reinhold Publishing Company, chapter 17, pages 440 to 458).

The ring 40 extends from the surface of the pipe string segment to radially of the upper edge 46 of the guide but does not extend radially to the inner surface of the wall of the bowl 41. To maintain the required flexibility for the wedging action below described while still having adequate surface toughness and hardness the ring 40 is preferably hollow being formed of upper and lower panels 91 and 92 and with space therebetween the panels joined by intermediate sections as 95 and 96. Holes as 93 and 94 may be provided between the section panels and intermediate sections. The uppers surface of the ring may also be provided with an annular groove 97 like the annular groove on the lower face. During the operation of the rig 18 when the drill pipe string 31 is stationary the ring 40 comes to the position shown in FIG. 4 with the hole face 67 in a close yet sliding engagement fit with the periphery of the drill pipe string surface and the flat face of groove 64 loosely engaging the top edge 46 of the guide 44. Edge 46 is smooth to not cut into the ring 40.

Figure 7:
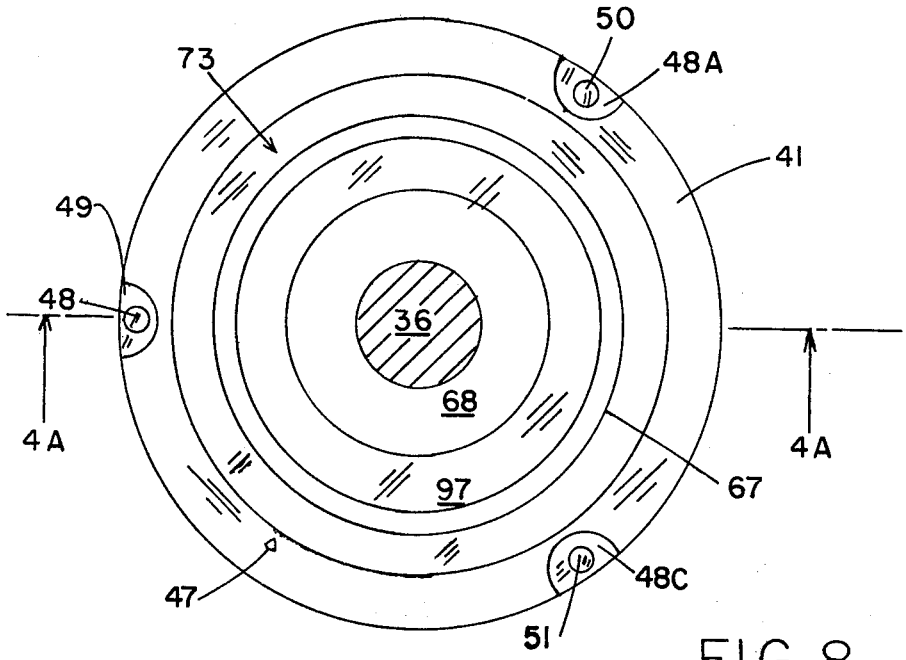
FIG. 7 is a top view looking into the chamber 47 along direction of arrow 7A of FIG. 4 and ring 40 in position shown in FIG. 4.
Figure 8:
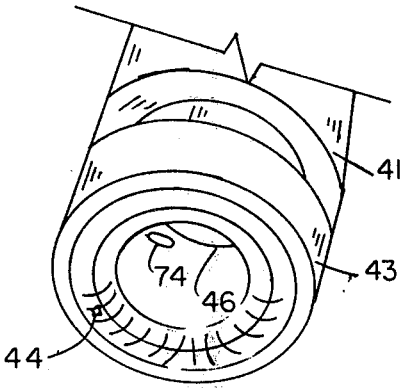
FIG. 8 is a bottom oblique view of the lower portion of wiper apparatus 37 as seen along direction of arrow 8A of FIG. 3.
Figure 9:
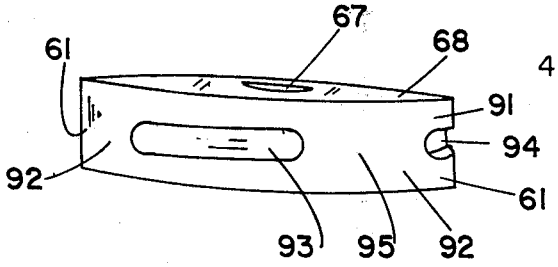
FIG. 9 is an end view of ring 40 as seen along direction of arrow 9A of FIG. 2.

At the bottom end of the wall of bowl 41 is a flat ring 71 together with an upstanding annular ledge portion 72 at the top of the guide 44, they form a pocket 73. The pocket is located below the bottom surface of the ring 40 in the position of parts shown in FIG. 4. The fit of the inner hole face 67 of the ring 40 is sufficiently firm and close to the outer surface of the drill pipe string 31 as shown in FIG. 7 that tools and like hard and tough objects which may fall through the opening 36 in the drill floor 35 and rotary table thereabove, fall into the pocket 73 and may be readily recovered therefrom. However the pocket 73 is sufficiently shallow, especially in view of holes as 74, 75, and 76 near the edge 46 that the grit and dirt that also enter the pocket 73 are washed through such holes; thereby the structure of apparatus 37 avoids any accumulation of small particles that would other-wise lessen the capacity of the pocket 73 to hold large heavy debris therein until such debris might be recovered. The cap 39 is readily removed from the body 38 for purposes of locating the ring 40 in the chamber 47 and also for access to the pocket 73.

During operation of the rig when the drill pipe string is rotated and when the mud is forced upward past the guide 44, and especially when the drill pipe string is moved upward in a direction as 81 in FIG. 5, the ring 40 is moved up-ward against the plate 54 so the upper surface 68 of the ring 40 contacts the bottom surface of the plate 54 and is thereby held in position and blocks passage of drilling mud upward through the hole 99 in floor 35. The ring 40 has substantial thickness and adequate stiffness to maintain its shape in such position and at the same time has sufficient resiliency to accomodate to the change in the diameter of the string as joints thereof are pulled past the hole face 67. In such position as shown in FIG. 5 the ring 40 serves to deflect and wipe from the drill string surface mud liquor which is carried upward by the upwardly moving pipe or otherwise driven past guide 44 and guides such mud in a path as shown in 82; such path extends from the drill pipe surface and along the bottom surface 62 of the ring 40 and then into the pocket 73, through the holes as 74, 75, and 76 or over the top of ledge 72. Such action returns such mud to the interior of the casing and thence via line 17 to the mud pit and so recovers it.

Additionally the structure of the ring is such that it also serves to increase the efficiency of the holding of the slips of such drill pipe string during such time as the separate segments as 36 of the pipe string are being added to or removed from the drill pipe string.

Generally, each of the slips (as 32 and 33) have serrated or toothed central portions (as 83 and 84 respectively) which engage the drill pipe string and hold it from vertical displacement; however, such engagement usually requires a downward vertical movement of the pipe string of about between 1 and 3 inches. During such downward movement the pipe string, which string is frequently not perfectly centered, engages the inner hole face 67 of the ring 40 and causes a distortion of the ring 40 generally as shown in FIG. 6 so that the rigid initially cylindrical surface 67 is distorted into a conical shape and the ring surfaces 68 and 62 which had initially been horizontal and extended transversely to the longitudinal axis of the string, generally as shown in FIGS. 4 and 5, are then at an acute angle thereto: such shape change causes a wedging action engagement between the drill pipe string and surface 67 centrally and a like engagement between the upper lip or edge 46 of the guide 44 and surface 62 radially. Such engagements permit the downward movement of the pipe relative to such ring, as the ring itself does not hold the pipe firmly, but there is thereby provided positive resistance to movement in the horizontal plane of the portion of drill pipe string engaged by the hole face 67 of the ring 40 and by the wedging contacts of the bottom face 62 of the ring with the top edge 46 of the guide 44. Such engagement reduces lateral vibration of the pipe string for a short but critical time during the downward movement of the pipe string relative to the serrated or toothed portions of the slips as 32 and 33. The diminution of such side-ways vibration enhances the grasping capacity of the toothed or serrated portion to engage the pipe string and prevents further slippage of the pipe string downwards as might otherwise permit a further downward dropping of the pipe string and a necessary later "fishing" operation.

The lug 57 on the plate 54 provides for orientation of the cap 39 relative to the body 38 for a proper positioning of the cap on the body and a firm connection of the cap to the body. Transverse pins as 85 extend through each of the pins 49, 50 and 51 to maintain the position of the cap relative to the body 38: those pins are in turn held by chains to prevent the loss of such pins while disengaged from the pins 49, 50, and 51.

In operation, accordingly, the apparatus 37 provides for a saving of mud during the upward movement of the pipe string and recovering of such drilling mud, which is a economic saving because it avoids loss of such liquid, and provides safety benefits by avoiding foot slippage by the operators on the drilling rig floor as well as removing the drilling mud liquor so that handling of the drill pipe string segments is facilitated. Further, as shown in FIG. 4 the apparatus 37 provides for preventing loss of materials such as wrenches, large nuts and the like that might otherwise drop through the holes 36 and 55 into the space between the drill pipe and the casing and damage the bit or the pipe string during the drilling operation. Further still, as shown in FIG. 6, the apparatus 37 provides for assisting the slips in their action of grasping the string at such times as when the only support for that string is provided by the slips.

Figure 3:
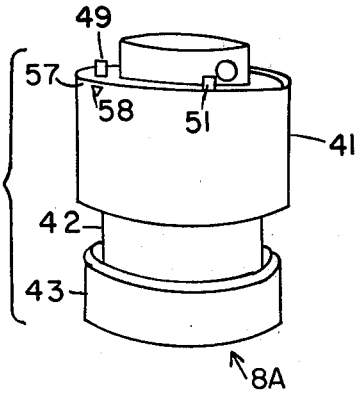
FIG. 3 is a perspective overall side view of the pipe wiper apparatus 37 of this invention.

In the exemplary embodiment 37 which is made of $\frac{1}{4}$ inch thick steel hereinabove described, the ring 40 height is 4 inches and the outside diameter is $13\frac{1}{2}$ inches. The bowl 41 has an outside diameter of 18 inches, the ledge diameter (46) is $10\frac{3}{4}$ inches and holes 74 are each $\frac{3}{4}$ inch high and 3 inches wide. The portions of the body 38 are firmly attached together by welding. Pocket 73 is 3 inches deep. FIGS. 3 and 7 are drawn to scale and other dimensions may be approximated therefrom for that embodiment.

I claim:

1. A pipe wiper apparatus comprising a rigid cylindrical shell, a removable rigid cap, and a resilient annular ring, the shell comprising a rigid upper cylindrical bowl wall, a rigid shell below and of lesser diameter than the bowl wall, and a rigid rim below said shell, a rigid internal guide firmly attached to the bottom edge of the rim and projecting to a narrower circular upper edge said upper edge projecting into a bowl chamber, within said bowl wall, said ring having an outer circular edge, an imperforate flat smooth bottom face, and a central cylindrical hole, said bottom face spaced apart from a top face by the thickness of said ring, said ring extending from said hole to radially of said upper edge and centrally of said bowl wall, a upwardly open annular pocket formed between said upper edge and said bowl wall, and open said bowl chamber, said cap comprising a flat rigid plate surounding an opening above said bowl chamber, releasable connecting means between said bowl and said cap, and said upper edge spaced vertically apart from said cap by a distance greater than the thickness of said ring.

2. Apparatus as in claim 1 wherein comprising holes in said ledge centrally of said pocket and above the bottom thereof, said holes located above level of the bottom of said pocket.

* * * * *